US011040226B2

(12) United States Patent
Wheatley et al.

(10) Patent No.: US 11,040,226 B2
(45) **Date of Patent: *Jun. 22, 2021**

(54) SERVICEABLE CARTRIDGE ASSEMBLY FOR RESPIRATOR EXHALATION UNIT

(71) Applicant: D. Wheatley Enterprises, Inc., Belcamp, MD (US)

(72) Inventors: David Wheatley, Belcamp, MD (US); Patrick Hulbert, Belcamp, MD (US); Stanley Rodowsky, Belcamp, MD (US)

(73) Assignee: D. WHEATLEY ENTERPRISES, INC., Belcamp, MD (US)

( * ) Notice: Subject to any disclaimer, the term of this patent is extended or adjusted under 35 U.S.C. 154(b) by 227 days.

This patent is subject to a terminal disclaimer.

(21) Appl. No.: 16/404,883

(22) Filed: May 7, 2019

(65) Prior Publication Data

US 2020/0346052 A1 Nov. 5, 2020

Related U.S. Application Data

(63) Continuation of application No. 14/541,780, filed on Nov. 14, 2014, now Pat. No. 10,279,204.

(Continued)

(51) Int. Cl.

*A62B 18/10* (2006.01)
*A62B 9/02* (2006.01)

(Continued)

(52) U.S. Cl.

CPC ..... *A62B 18/10* (2013.01); *A62B 9/02* (2013.01); *A62B 18/00* (2013.01); *A62B 18/08* (2013.01);

(Continued)

(58) Field of Classification Search

CPC .... A61M 16/00; A61M 16/20; A61M 16/201; A61M 16/206; A61M 16/207; A61M 16/208; A61M 16/209; A62B 7/00; A62B 9/00; A62B 9/02; A62B 9/027; A62B 9/022; A62B 9/025; A62B 18/00;

(Continued)

(56) References Cited

U.S. PATENT DOCUMENTS 3,474,783 A * 10/1969 Ulmann ..... F16K 15/148 128/206.15
3,575,206 A * 4/1971 Ulmann ..... A62B 18/10 137/529

(Continued)

*Primary Examiner* — Colin W Stuart
(74) *Attorney, Agent, or Firm* — Whiteford, Taylor & Preston, LLP; Gregory M. Stone

(57) ABSTRACT

Disclosed is a modular serviceable cartridge assembly for a respirator exhalation unit that is simple in construction and that allows quick-connect of an exhalation valve cartridge in a mask to minimize the need for reconfiguration when changing personal protective equipment, and that allows for easy removal and breakdown for servicing and/or replacement of individual components of the exhalation valve without modifying or replacing other elements of the protective mask. The assembly may be convertible from a negative pressure valve assembly to a positive pressure valve assembly, and vice versa, and a grill may be provided on an outlet side of the cartridge assembly, the rotation of which converts the assembly from a negative pressure valve to a positive pressure valve.

17 Claims, 14 Drawing Sheets

Related U.S. Application Data

(60) Provisional application No. 61/904,273, filed on Nov. 14, 2013.

(51) Int. Cl.
*A62B 18/00* (2006.01)
*A62B 18/08* (2006.01)
*A62B 18/02* (2006.01)

(52) U.S. Cl.
CPC ..... *A62B 9/027* (2013.01); *A62B 18/02* (2013.01); *A62B 18/025* (2013.01)

(58) Field of Classification Search
CPC ..... A62B 18/02; A62B 18/025; A62B 18/04; A62B 18/045; A62B 18/08; A62B 18/10; A62B 18/086; F16K 31/1221; F16K 31/52; F16K 1/00; F16K 7/00; F16K 7/12; F16K 7/16; F16K 15/00; F16K 15/06; F16K 15/063; F16K 15/14
See application file for complete search history.

(56) References Cited

U.S. PATENT DOCUMENTS 3,743,245 A * 7/1973 Demler, Sr. ..... F16K 7/16 251/257
2008/0257352 A1* 10/2008 Penton ..... A62B 7/04 128/205.24
2012/0046582 A1* 2/2012 Hopman ..... A61B 17/1327 602/4

* cited by examiner

SERVICEABLE CARTRIDGE ASSEMBLY FOR RESPIRATOR EXHALATION UNIT

CROSS-REFERENCE TO RELATED APPLICATIONS

This application is a continuation of U.S. patent application Ser. No. 14/541,780 entitled "Serviceable Cartridge Assembly for Respirator Exhalation Unit," filed with the U.S. Patent and Trademark Office on Nov. 14, 2014 and now U.S. Pat. No. 10,279,204 issued May 7, 2019, which application is based upon and claims priority from U.S. Provisional Patent Application Ser. No. 61/904,273 entitled "Serviceable Cartridge Assembly for Respirator Exhalation Unit," filed with the United States Patent and Trademark Office on Nov. 14, 2013, the entire disclosures of which are incorporated herein by reference in their entireties.

GOVERNMENT LICENSE RIGHTS

This invention was made with Government support under contract number W91CRB-11-D-0001 awarded by the U.S. Army. The Government may have certain rights in the invention.

FIELD OF THE INVENTION

This invention relates generally to breathing apparatus for protective masks, and more particularly to exhalation valve assemblies for use on protective masks configured to cooperate with varied personal protective equipment.

BACKGROUND

Protective masks have long been used to protect the wearer in hazardous environments from inhaling contaminants and potentially harmful materials. They provide a protective, breathable environment to the wearer in contaminated and environmentally threatening conditions, such as fires, chemical spills, radiological events, etc. that might be faced by firefighters, first responders, etc. Protective masks are typically configured with a facemask and valved assemblies for controlling the flow of air to and from the interior of the mask.

The entrance of air into the mask interior may be (by way of non-limiting example) through one or more filters, from self-contained breathing apparatus (SCBA), or through powered air purifying respirators (PAPR), or other air supply mechanisms as may be known to those having ordinary skill in the art.

More particularly, in one mask configuration, air is drawn into the mask interior through the wearer's inhalation, creating a negative pressure environment inside the mask (with respect to ambient air pressure), with the air typically being drawn into the mask through one or more air purifying filter canisters. As the user exhales, a positive pressure is created in the interior of the mask, and a check valve typically opens to allow the exhaled air to exit the mask through an outlet. In this configuration, a simplistic negative pressure valve is typically used to prevent contaminated air from entering through the outlet during the wearer's inhalation.

Likewise, in another mask configuration, air is supplied to the mask in a SCBA system from an air supply, such as an air tank, which provides a positive pressure environment inside of the mask. As the wearer inhales, a supply valve opens to allow air into the mask from the tank. As the user exhales, the supply valve closes and the check valve opens to release the exhaled air out from the mask.

Still further, in yet another mask configuration, air is supplied to the mask in a PAPR system from a motorized blower that delivers filtered air to the mask, again creating a positive pressure environment insider of the mask. The pressure supplied by the blower is typically lower than pressure supplied through a SCBA system, and is thus sent from the blower (at times through a supply valve), through a hose and into the interior of the mask. Once again, as the wearer exhales, the supply valve closes and the check valve opens to release the exhaled air from the mask.

A challenge exists, however, in that the above-described varying mask configurations, each of which is particularly desirable for a particular set of threat conditions, require variously configured exhalation valves. Specifically, the pressure that the exhalation valve must maintain in order to not inadvertently open and allow contaminated air into the mask will vary with the pressure created inside of the mask environment, which in turn will vary with the protective equipment configuration being used (i.e., whether such configuration includes filter canisters mounted to a mask, a PAPR system, a SCBA system, or other systems). Moreover, the pressure that the user must overcome by the check valve to allow their exhaled air to exit must likewise be balanced so as to not excessively stress the wearer. Thus, in the event that a wearer must change their protective equipment due to a changing threat environment, they typically will not only need to change the protective equipment itself, but likewise will need to change the exhalation valve configuration in order to provide an exhalation assembly that is properly fitted to the selected protective equipment.

Even further, given the harsh operating conditions in which such protective mask assemblies are used, the exhalation assemblies are quite prone to damage due to prolonged exposure to the threatening environment. Unfortunately, however, in typical exhalation units used with such protective masks, the exhalation valve assemblies are complex and enclosed, requiring that the entire unit be replaced in the event that individual components of the exhalation valve assembly require service or replacement.

It would therefore be advantageous to provide an exhalation valve assembly for use with protective masks that is easily adaptable to use with varied personal protective equipment configurations without changing out the exhalation valve structure, that is less complex than previously known exhalation valve assemblies, and that allows easy breakdown so that the wearer may easily service the components of the exhalation valve unit.

SUMMARY OF THE INVENTION

Disclosed is a serviceable cartridge assembly for a respirator exhalation unit that is modular, simple in construction, and that allows quick-connect of an exhalation valve cartridge in a mask to minimize the need for reconfiguration when changing personal protective equipment, and that allows for easy removal and breakdown for servicing and/or replacement of individual components of the exhalation valve without modifying or replacing other elements of the protective mask. The assembly may be convertible from a negative only pressure valve assembly to a negative/positive pressure valve assembly, and vice versa, and a grill may be provided on an outlet side of the cartridge assembly, the rotation of which converts the assembly from a negative pressure valve to a positive pressure valve. Moreover, the components of the cartridge assembly are modular, such that one grill configured as a rotating grill that converts the valve from a negative only valve system to a negative/positive valve system may be quickly and easily replaced with an alternative, static and fixed grill. Likewise, given such modular construction, the internal components of the cartridge assembly that act between the rotating grill and the valve (in the negative/positive pressure valve system) may be quickly and easily removed. With this configuration, the assembly may be easily modified from a negative/positive field serviceable valve system to a negative only field serviceable valve system, and vice versa, with minimal effort on the part of the operator.

In accordance with certain aspects of an embodiment of the invention, a serviceable cartridge assembly for a respirator exhalation unit is provided, comprising: a cylindrical cartridge body having an air inlet side and an air outlet side; a negative pressure valve positioned on an interior of the cylindrical cartridge body and configured to seal the air inlet side upon creation of a pressure below ambient pressure upstream of the air inlet side, the negative pressure valve being frictionally held within the air inlet side of the cylindrical cartridge body; and a grill removably attached to the air outlet side of the cylindrical cartridge body and having a circumferential edge forming a snap fit connection with a circumferential recess on an interior of the cylindrical cartridge body adjacent the outlet side of the cylindrical cartridge body.

In accordance with further aspects of an embodiment of the invention, a serviceable cartridge assembly for a respirator exhalation unit is provided, comprising: a cylindrical cartridge body having an air inlet side and an air outlet side; a valve positioned on an interior of the cylindrical cartridge body, the valve being reconfigurable from a negative pressure valve to a positive pressure valve and configured to seal the air inlet side, the valve being frictionally held within the air inlet side of the cylindrical cartridge body; and a grill removably attached to the air outlet side of the cylindrical cartridge body and having a circumferential edge forming a snap fit connection with a circumferential recess on an interior of the cylindrical cartridge body adjacent the outlet side of the cylindrical cartridge body.

BRIEF DESCRIPTION OF THE DRAWINGS

The numerous advantages of the present invention may be better understood by those skilled in the art by reference to the accompanying drawings in which.

DETAILED DESCRIPTION OF PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Disclosed herein is a removable cartridge assembly for use in a respirator exhalation unit, such as an exhalation unit on a protective mask, such as a gas mask. Such removable cartridge assembly is particularly configured to allow users to easily breakdown the components of the cartridge assembly for service, such as when individual components of the cartridge assembly need to be replaced, or when portions of the assembly need to be cleaned or cleared of debris or contaminants. The removable cartridge assembly described herein may be used in a variety of respirator exhalation units, including by way of non-limiting example a respirator exhalation unit as set forth in U.S. Pat. No. 7,866,319, the specification of which is incorporated herein by reference thereto in its entirety.

Figure 1:
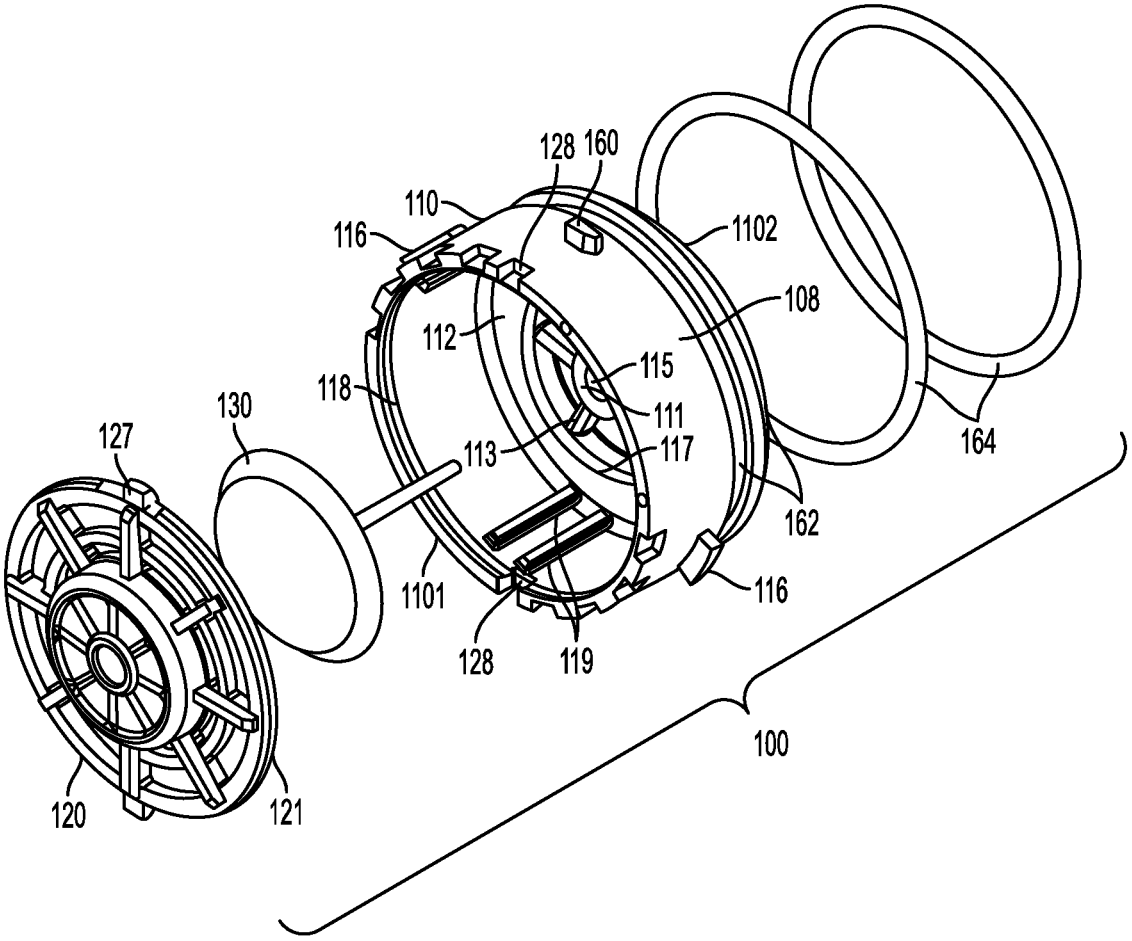
FIG. 1 is an exploded view of a removable cartridge assembly in accordance with certain aspects of an embodiment of the invention.
Figure 2:
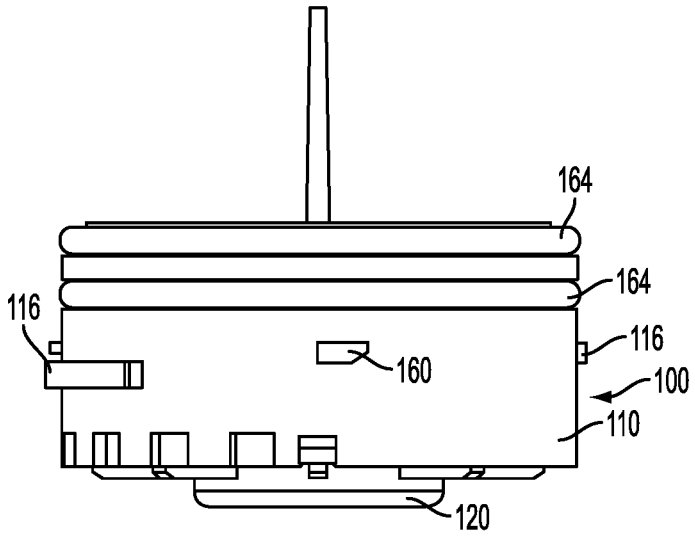
FIG. 2 is a front view of the assembled removable cartridge assembly of FIG. 1.
Figure 3:
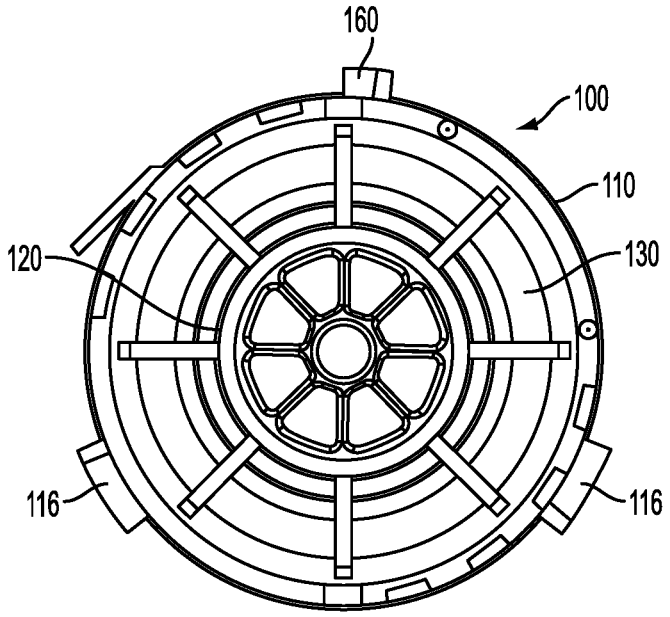
FIG. 3 is a top view of the assembled removable cartridge assembly of FIG. 1.
Figure 4:
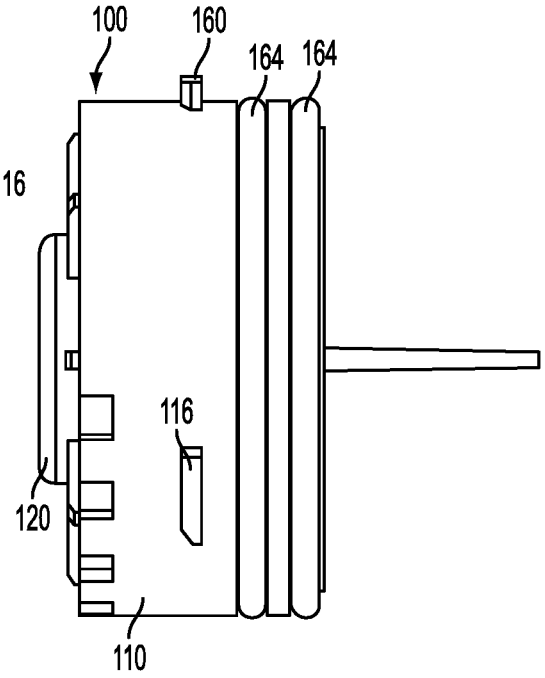
FIG. 4 is a side view of the assembled removable cartridge assembly of FIG. 1.

FIG. 1 shows an exploded view of a removable cartridge assembly (shown generally at 100) in accordance with certain aspects of an embodiment of the invention. Likewise, FIGS. 2, 3 and 4 provide front, top, and side views, respectively, of removable cartridge assembly 100 in a fully assembled state. The removable cartridge assembly shown in FIGS. 1 through 4 is particularly configured for use in a negative pressure only valve system. In such negative pressure only valve system, air pressure inside of a mask to which an exhalation unit is attached is negative (with respect to ambient pressure) during inhalation, and is positive during exhalation. During inhalation, air enters the mask through, for instance, a filter, such as a CBRN filter, and during exhalation, air exists the mask through the exhalation unit through a check valve. In the embodiment of FIG. 1, the removable cartridge assembly 100 includes a cartridge body 110, a front grill 120 that may be removably attached to a front edge 1101 corresponding to the outlet side of cartridge body 110, and a negative pressure valve 130 that may be removably attached to cartridge body 110 through a central opening 115 at the inlet side 1102 of cartridge body 110, each of which components are discussed in greater detail below.

Figure 5:
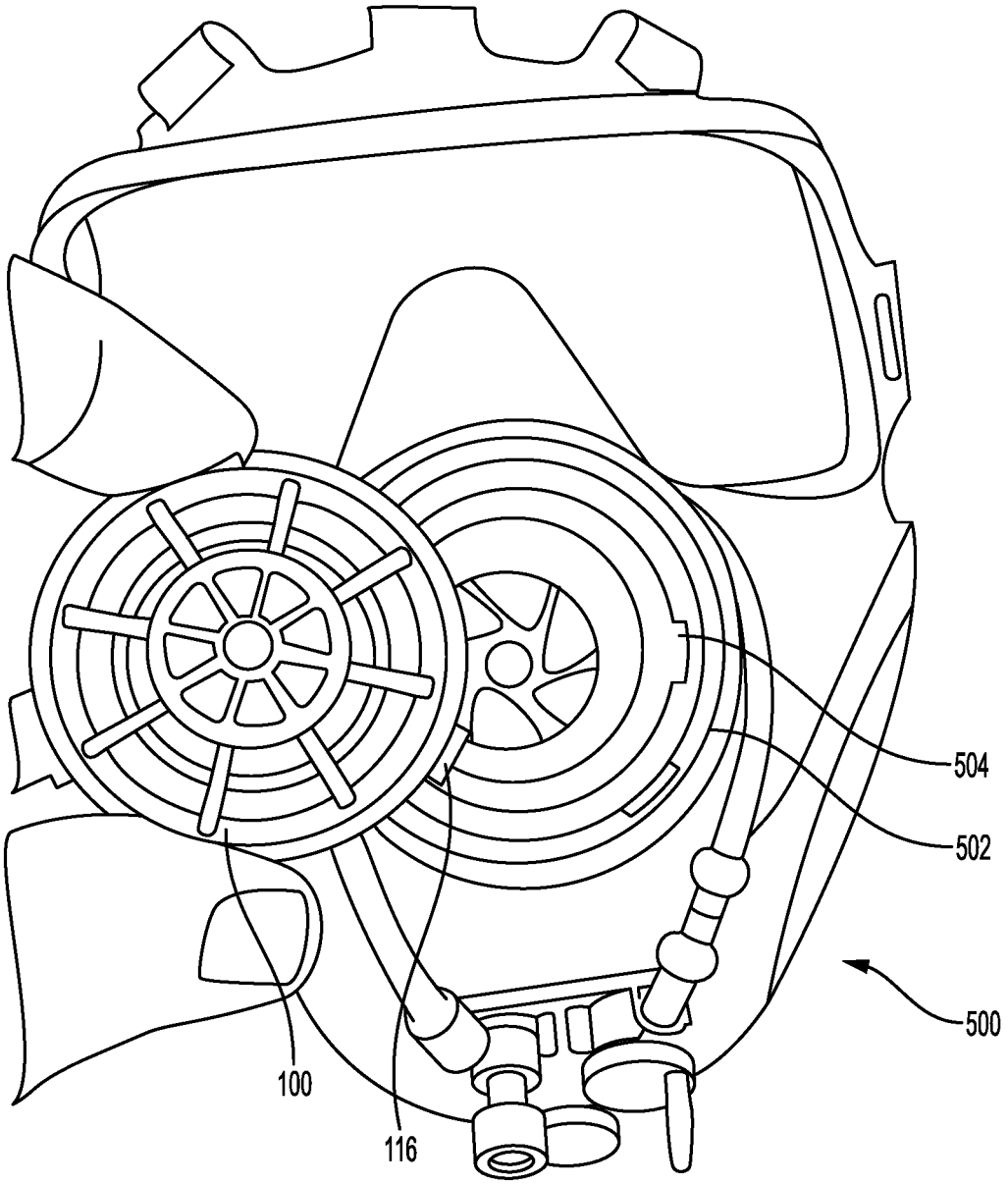
FIG. 5 is a front view of the removable cartridge assembly of FIG. 1 positioned for placement within a protective mask.
Figure 6:
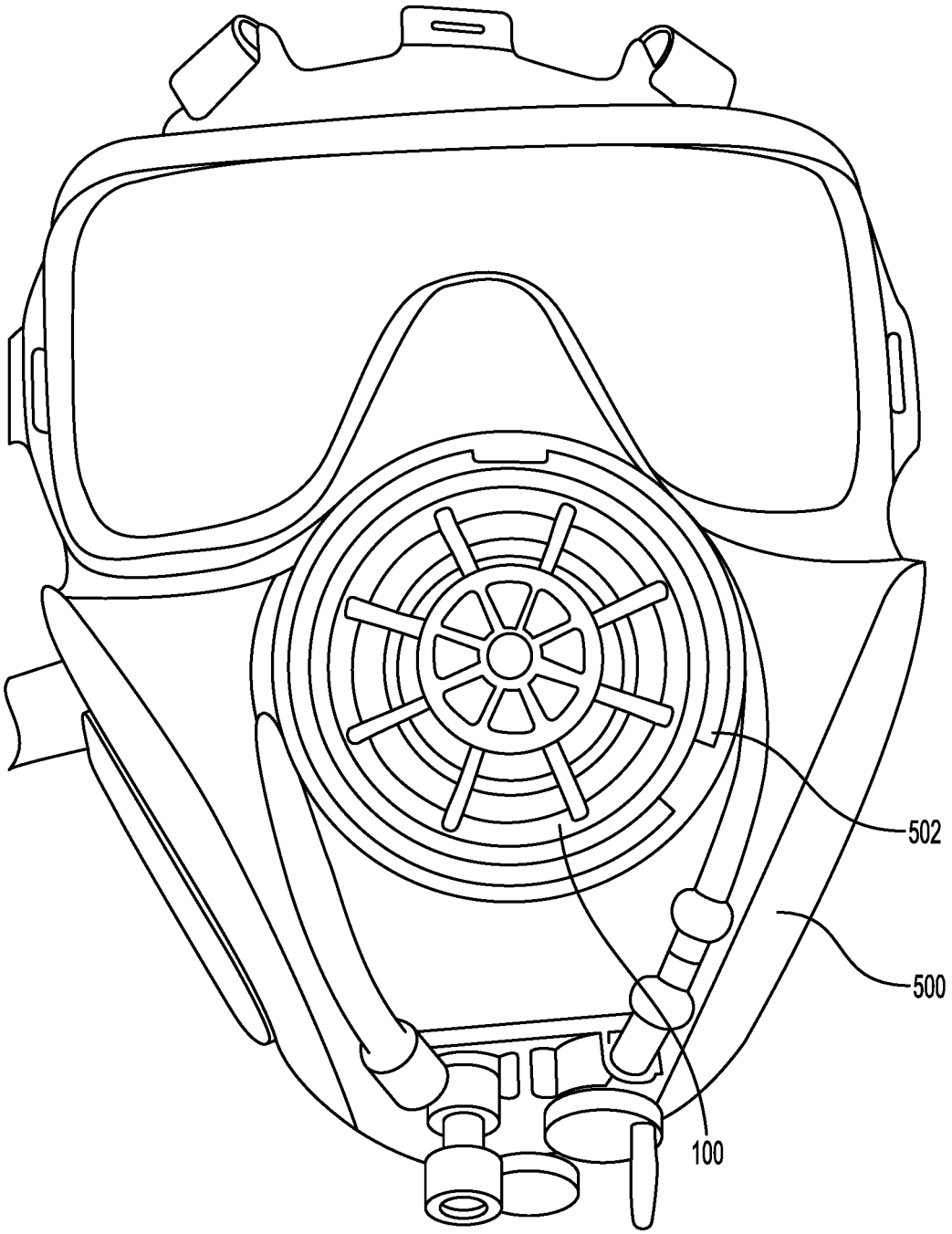
FIG. 6 is a front view of the removable cartridge assembly of FIG. 1 mounted within a protective mask.

Removable cartridge assembly 100 is configured for removable placement within the exhalation unit mount 502 of a protective mask 500, as shown in FIG. 5 (showing removable cartridge assembly 100 about to be placed into the exhalation unit mount 502 of a protective mask 500) and 6 (showing removable cartridge assembly 100 seated within exhalation unit mount 502 of protective mask 500). In order to allow for the quick connect attachment of removable cartridge assembly 100 with exhalation unit mount 502 of a protective mask, flanges 116 are positioned on an outer cylindrical wall 108 of cartridge body 110, which flanges 116 align with openings 504 in exhalation unit mount 502 of mask 500 that initially receive flanges 116, and are positioned adjacent a ridge or shelf (not shown) that hold flanges 116 in place as cartridge body 110 is turned within exhalation unit mount 502 in typical bayonet connection fashion. Optionally, one flange 160 may be provided having a shorter length than the remaining flanges 116, and one of openings 504 may likewise have a shorter length than the remaining openings, to provide a proper alignment of removable cartridge assembly 100 when it is fitted into exhalation unit mount 502 of mask 500. Moreover, a forward edge of each flange may optionally be tapered to further aid in the engagement of each flange with its intended ridge or shelf as cartridge body 110 is turned within exhalation unit mount 502. To further aid in sealing removable cartridge assembly 100 in exhalation unit mount 502, cartridge body 110 may also be provided channels 162 extending circumferentially around cartridge body 110 adjacent inlet side 1102, with each channel 162 receiving a compressible seal 164, such as an O-ring, to provide an air tight connection between the exterior of removable cartridge assembly 100 and the exhalation unit mount 502 of mask 500.

Negative pressure valve 130 is positioned within the interior of cartridge body 110 and sits against a valve seat 117 (discussed in greater detail below), and front grill 120 sits within the open mouth at the outlet side 1101 of cartridge body 110, frictionally held within cartridge body 110 so as to remain in place during use, but allowing removal without damage when intentionally pried away from cartridge body 110.

Figure 8:
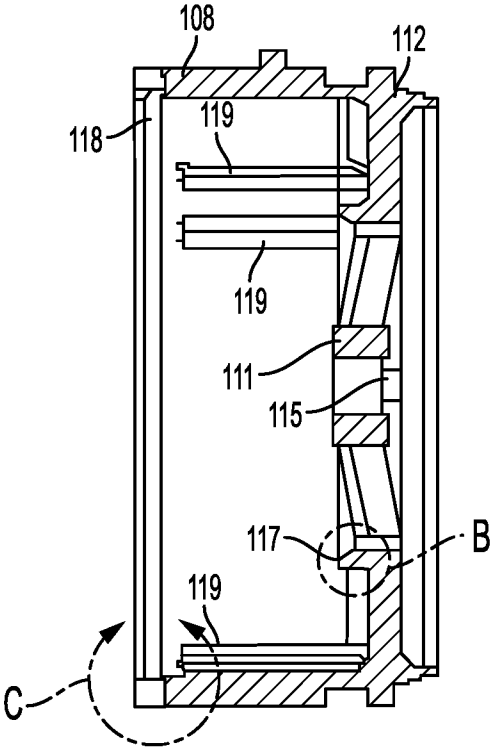
FIG. 8 is a cross-sectional view of the removable cartridge assembly of FIG. 7 along section line A-A of FIG. 7.
Figure 7:
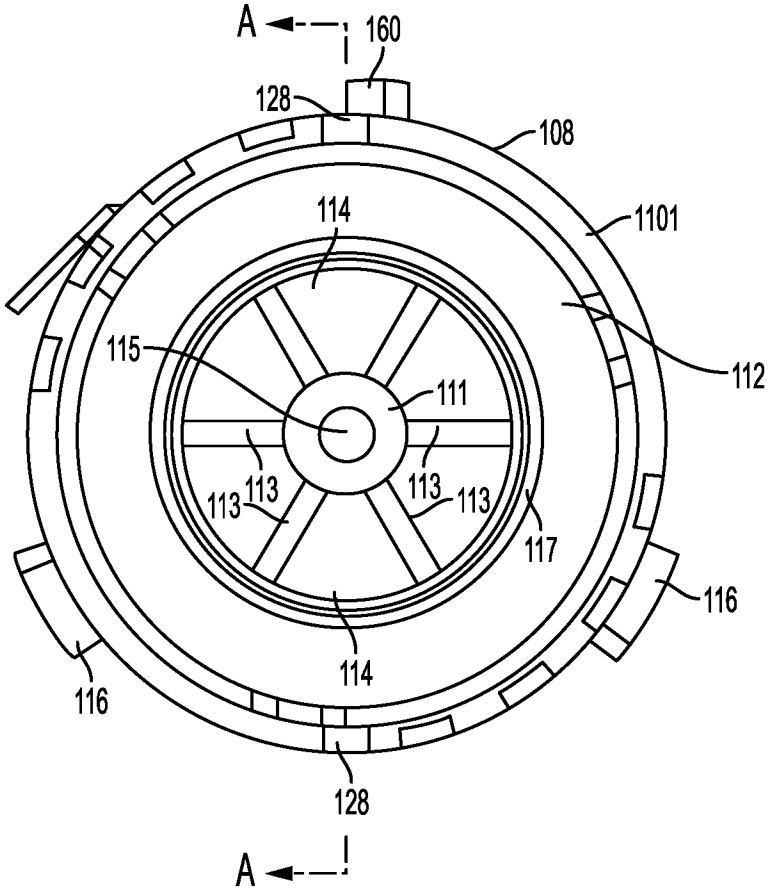
FIG. 7 is a top view of the removable cartridge assembly of FIG. 1 with a front grill removed.
Figure 9:
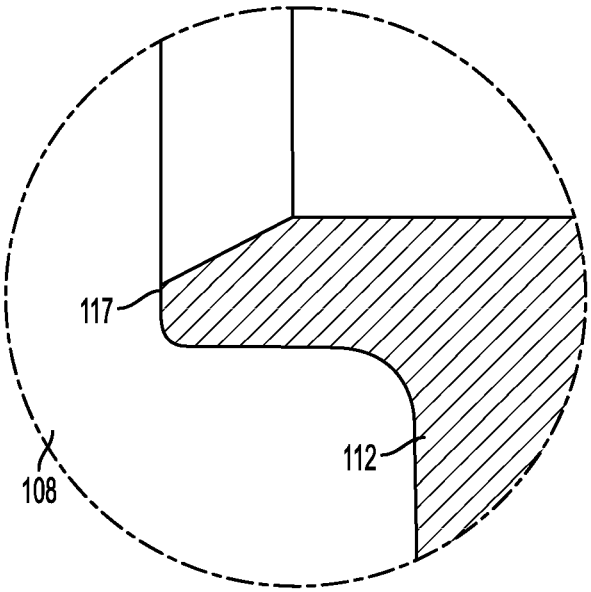
FIG. 9 is a close-up view of a valve seal for use with the removable cartridge assembly of FIG. 7.
Figure 10:
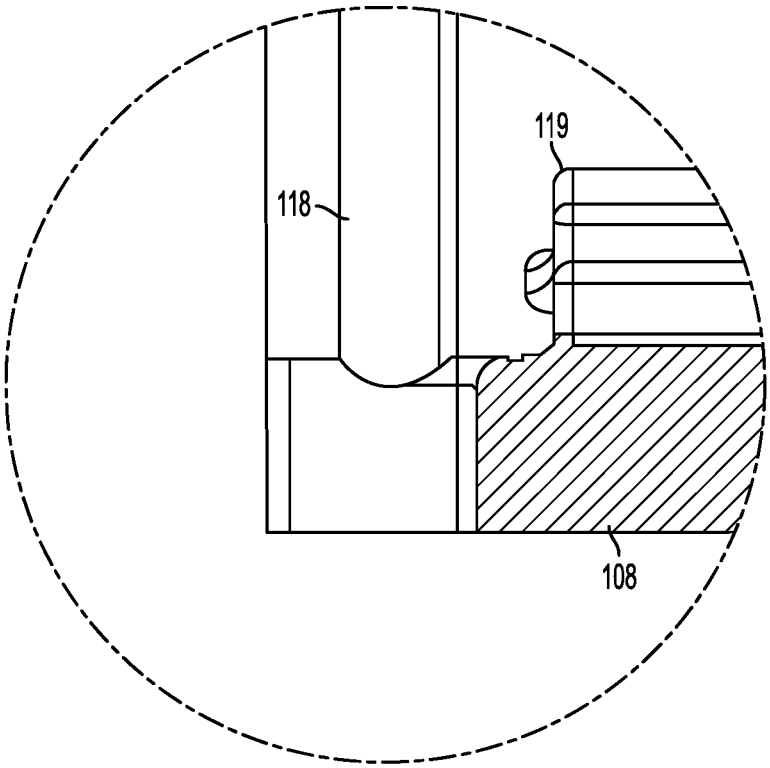
FIG. 10 is a close-up view of a recess for mounting a grill on the removable cartridge assembly of FIG. 7.

FIG. 7 provides a front view of cartridge body 110 (i.e., viewing from the outlet side 1101) with front grill 120 removed, and FIG. 8 provides a cross-sectional view of the cartridge body 110 of FIG. 7 along section line A-A. An inlet end wall 112 is positioned at the inlet side 1102 of cylindrical wall 108 of cartridge body 110, and includes a central hub 111 attached to inlet end wall 112 by a plurality of radial arms 113. Radial arms 113 are spaced apart, such that openings 114 exist between each pair of radial arms 113, allowing air to pass through the inlet end wall 112 and into the interior of cartridge body 110. Central hub 111 also has a central opening 115 configured to receive the valve stem of negative pressure valve 130, providing a removable connection of negative pressure valve 130 to the rest of the respirator exhalation unit. The interior, downstream side of the inlet end wall 112 also defines a valve seat 117 against which negative pressure valve 130 sits in a closed position (i.e., during inhalation into the mask 500), and away from which at least a portion of negative pressure valve 130 moves or deflects in an open position (i.e., during exhalation from the mask 500). The valve stem of valve 130 is removably received in a narrowed portion of hub central opening 115, and as there is no other attachment between valve 130 and cartridge body 110 other than the frictional forces between the valve stem and hub central opening 115, the valve 130 can be easily removed and replaced when worn, or simply moved to allow cleaning and clearing of the openings 114 if and when they become fouled with debris. FIG. 9 provides a close-up view of section B of FIG. 8, particularly showing valve seat 117 extending upward from inlet end wall 112 and having a slightly curved outer edge, against which an underside of valve 130 sits to seal inlet side 1102 of cartridge body 110.

After a user has performed any such required or desired maintenance, removable front grill 120 may be replaced into the front, outlet side 1101 of cartridge body 110. To facilitate the proper, aligned placement of front grill 120 into cartridge body 110, and as shown in both FIG. 8 and the close-up view C shown in FIG. 9*a*, a rounded, concave recess 118 extends around the circumference of cartridge body 110 adjacent outlet side 1101, into which a rounded, convex edge 121 of front grill 120 may be snap-fitted for easy, removable attachment to cartridge body 110. Likewise, longitudinal positioning spacers 119 are provided on the interior of cartridge body 110, and may be sized so as to sit against the upstream side of front grill 120 when properly positioned within the open end of cartridge body 110.

Figure 11:
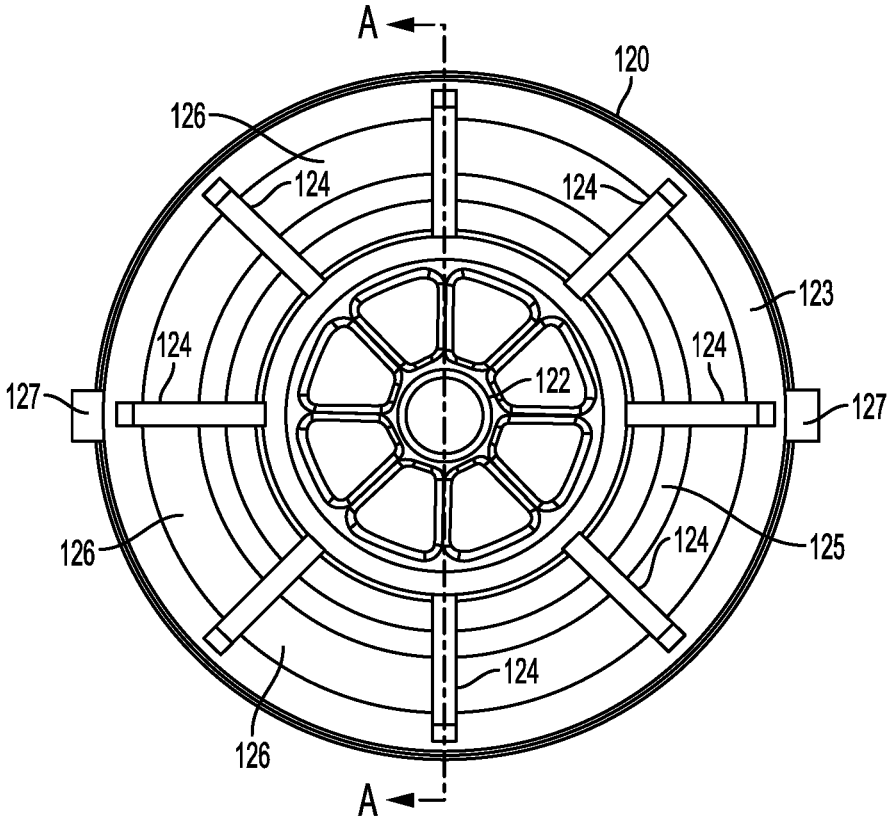
FIG. 11 is a top view of a grill for use with the removable cartridge assembly of FIG. 7.
Figure 12:
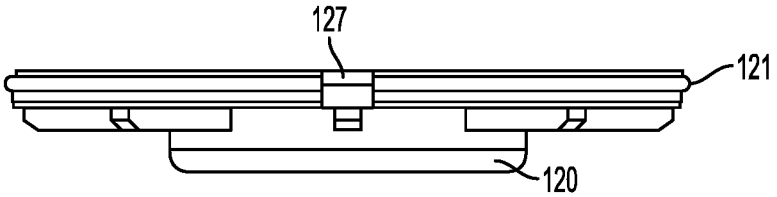
FIG. 12 is a side view of the grill of FIG. 11.
Figure 13:
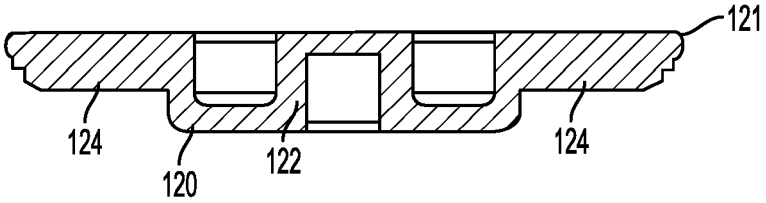
FIG. 13 is a cross-sectional view of the grill of FIG. 11 along section line A-A.

FIG. 11 provides a top view, and FIG. 12 a side view, of front grill 120. Likewise, FIG. 13 provides a cross-sectional view of front grill 120 along section line A-A of FIG. 11. Front grill 120 has an outer diameter sized to fit within the open end of cartridge body 110 adjacent the outlet side 1101. More particularly, and as referenced above, front grill 120 has a rounded, convex edge 121 at its outer-most circumferential edge, which convex edge 121 is configured to fit closely within concave recess 118 at the open end of cartridge body 110 in a snap-fit type of engagement, allowing the front grill 120 to be held firmly in place during use, but likewise allowing its intentional removal from cartridge body 110 without damage to the cartridge assembly 100 when desired for service purposes. Front grill 120 includes a central hub 122, an outer rim 123, and a plurality of radial ribs 124 connecting central hub 122 and outer rim 123. One or more interior rims 125 may also be provided. Openings 126 exist between adjacent radial ribs 124, which openings 126 allow air to pass through front grill 120. Positioning tabs 127 are provided at the outer edge of front grill 120, and align with notches 128 on cartridge body 110 to properly, angularly align front grill 120 within the open front of cartridge body 110. Positioning ribs 127 are preferably sized so as to fit closely within notches 128, providing a further frictional connection between front grill 120 and cartridge body 110.

Figure 14:
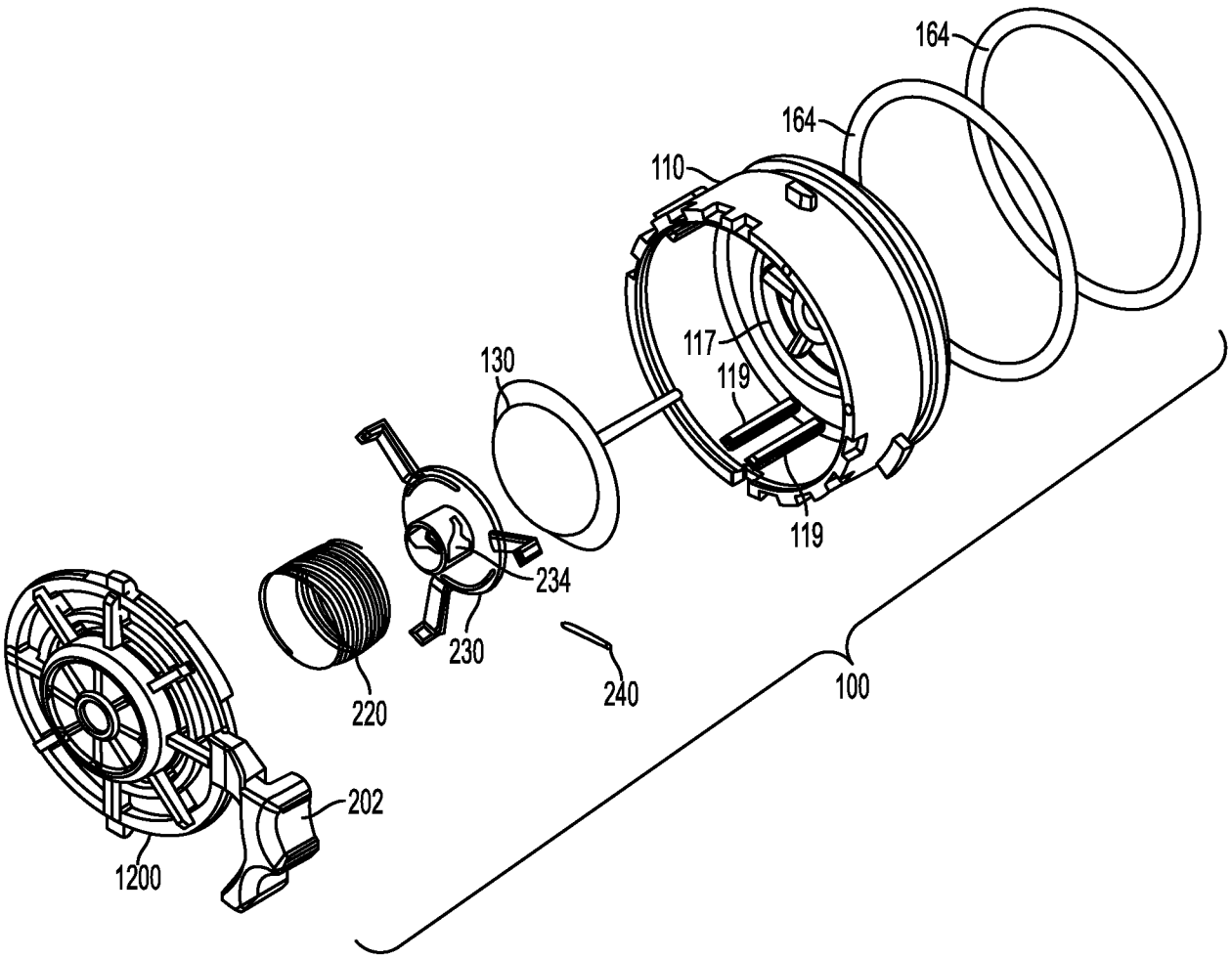
FIG. 14 is an exploded view of a removable cartridge assembly in accordance with further aspects of an embodiment of the invention.
Figure 15:
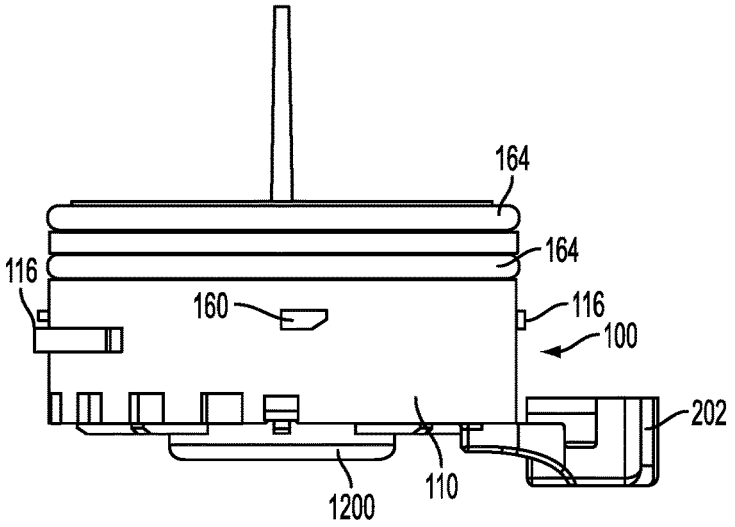
FIG. 15 is a front view of the assembled removable cartridge assembly of FIG. 14.
Figure 16:
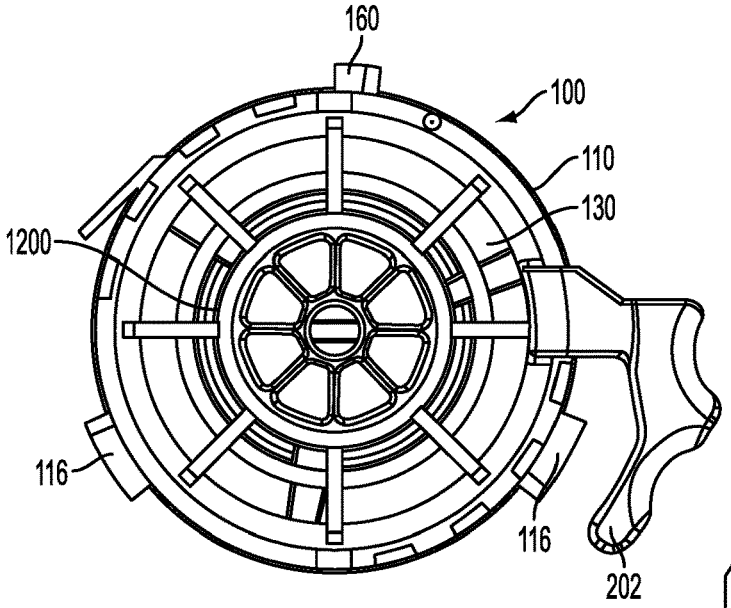
FIG. 16 is a top view of the assembled removable cartridge assembly of FIG. 14.
Figure 17:
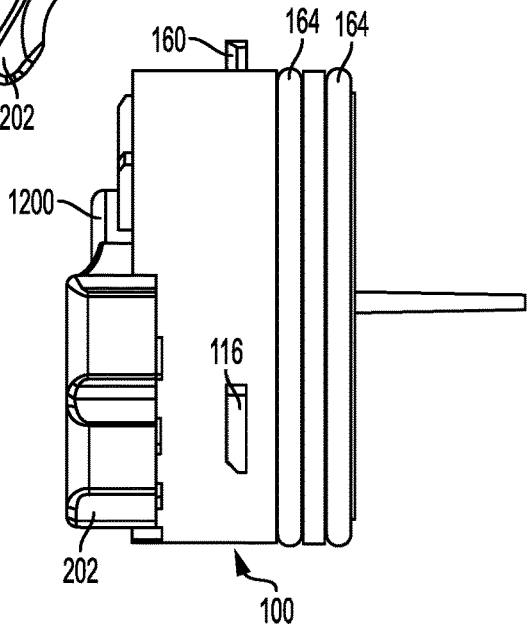
FIG. 17 is a side view of the assembled removable cartridge assembly of FIG. 14.

Next, and as shown in the exploded view of FIG. 14 and the front, top, and side view of FIGS. 15, 16, and 17, respectively, removable cartridge assembly 100 may also be used in a negative/positive pressure valve system by providing a modified front grill 1200 and a spring-biased load disc 230. In this system configuration, air pressure inside of mask 500 may be maintained slightly positive (with respect to ambient), such as when used with a PAPR or an SCBA, or alternatively may be maintained negative (again with respect to ambient), operating as set forth in the description above. When maintained in a positive pressure condition, while exhalation still occurs through the check valve in the exhalation unit, the check valve should have greater exhalation resistance than in the negative-only condition. Thus, and with reference to FIGS. 14 through 17, the removable cartridge assembly (shown generally at 100) includes a cartridge body 110 (in the same configuration as that described above), a front grill 1200, and a negative pressure valve 130 (again configured as described above), along with a load disc spring 220, an outlet valve load disc 230 that is biased by load disc spring 220 against valve 130 (the other end of load disc spring 220 being positioned against the interior face of front grill 1200), and a roll pin (lifting member) 240 that extends through a guide channel 234, with cam surface as shown, in outlet valve load disc 230 so as to axially guide load disc 230 between a negative only position (in which it does not engage valve 130) and a positive position (in which it does engage valve 130).

Figure 18:
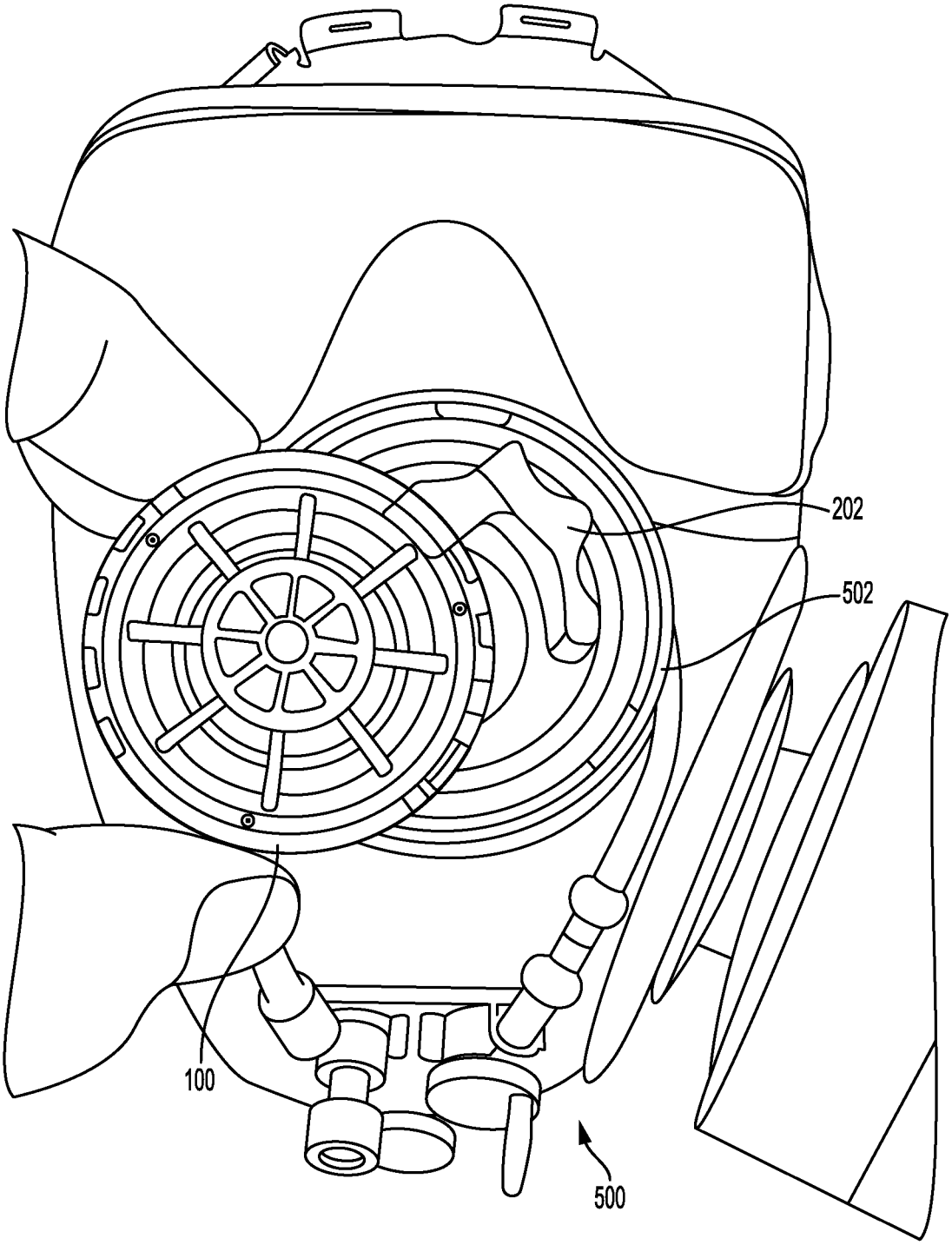
FIG. 18 is a front view of the removable cartridge assembly of FIG. 14 positioned for placement within a protective mask.
Figure 19:
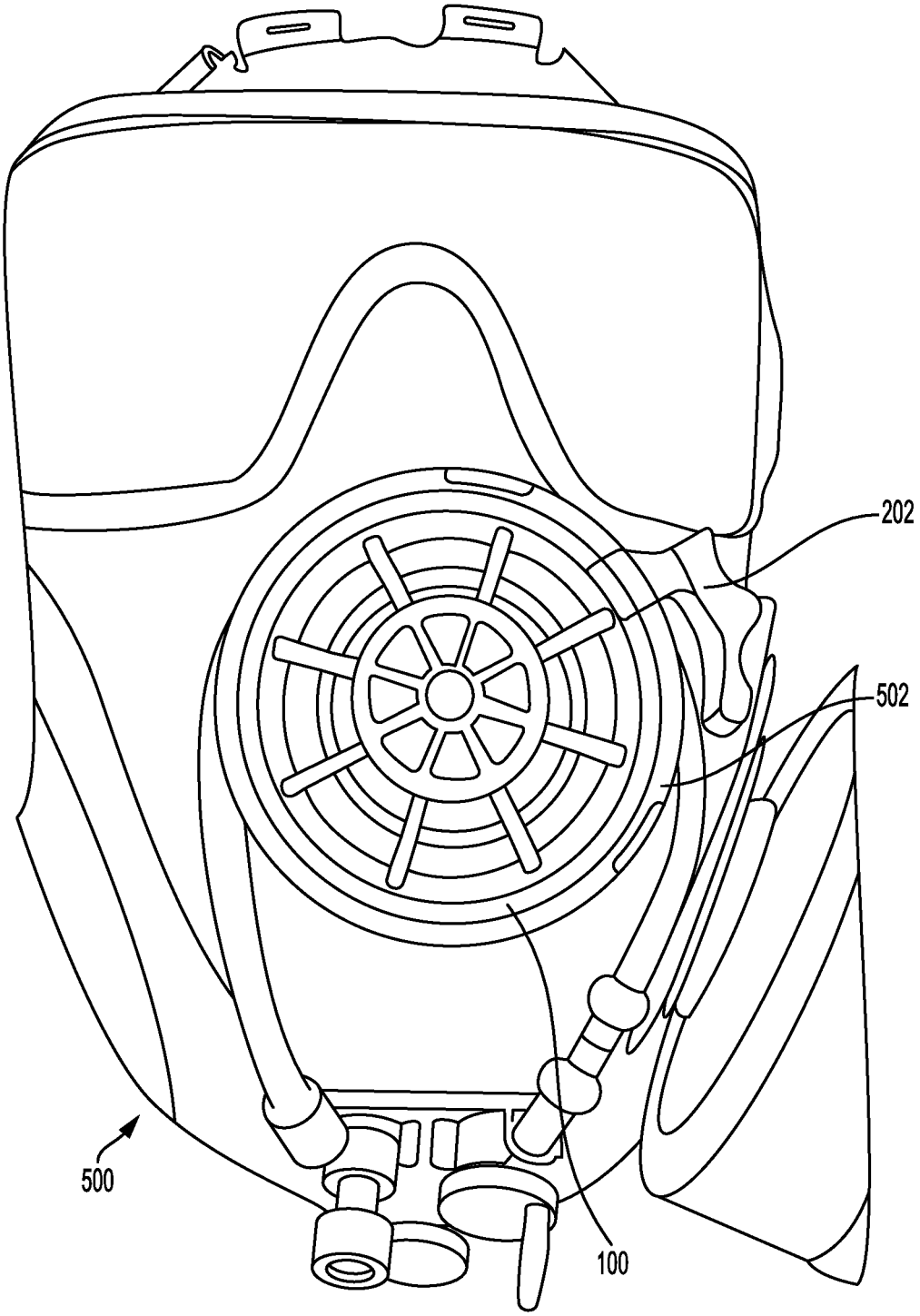
FIG. 19 is a front view of the removable cartridge assembly of FIG. 14 mounted within a protective mask.

In the negative/positive pressure valve system configuration, removable cartridge assembly 100 is again configured for removable placement within the exhalation unit mount 502 of a protective mask 500, as shown in FIG. 18 (showing removable cartridge assembly 100 about to be placed into the exhalation unit mount 502 of a protective mask 500) and 19 (showing removable cartridge assembly 100 seated within exhalation unit mount 502 of protective mask 500), all as described above with respect to the negative pressure only configuration. Moreover, and as discussed in greater detail below, a handle 202 is positioned on the downstream side of front grill 1200 and is positioned to sit forward of a front edge of exhalation unit mount 502 so as to allow a user to rotate front grill 1200 with respect to cartridge body 110 when it is installed within mask 500.

As with the negative pressure only configuration described above with regard to FIGS. 1 through 13, negative pressure valve 130 is positioned within the interior of cartridge body 110 and sits against valve seat 117, and front grill 1200 sits within the open end adjacent the outlet side 1101 of cartridge body 110, frictionally held within cartridge body 110 so as to remain in place during use, but allowing removal without damage when intentionally pried away from cartridge body 110.

Figure 20:
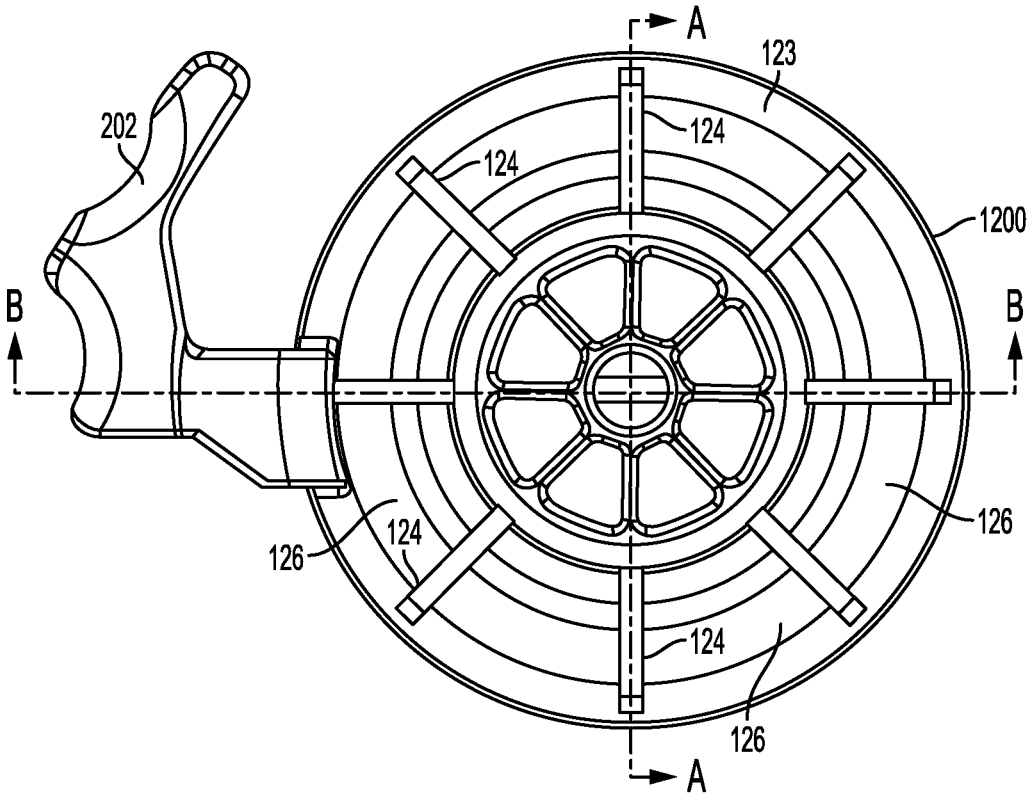
FIG. 20 is a top view of a grill for use with the removable cartridge assembly of FIG. 14.
Figure 21:
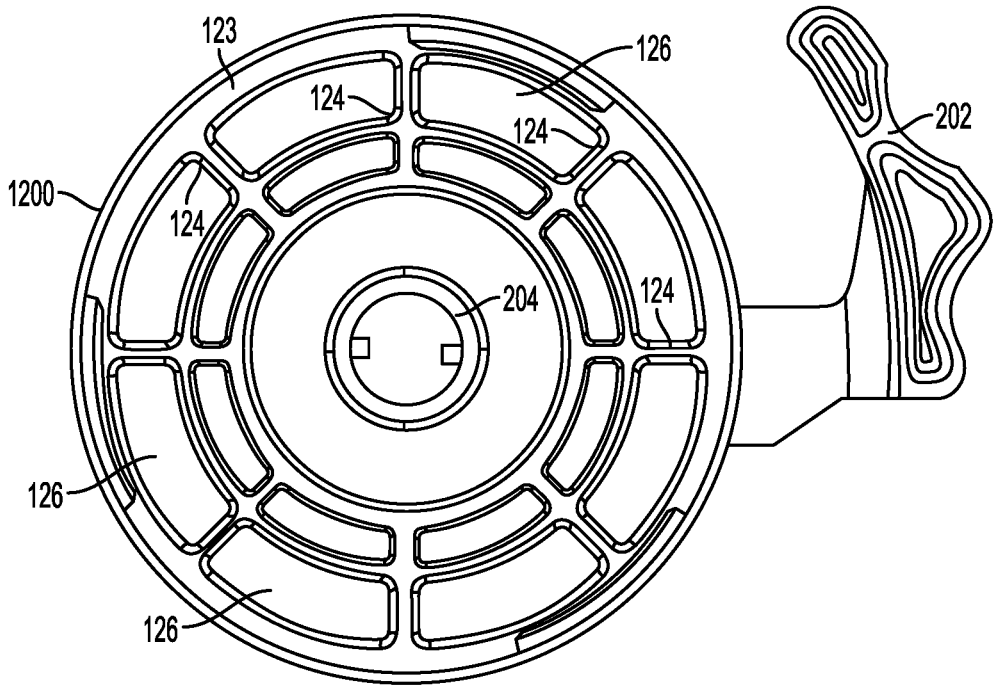
FIG. 21 is a bottom view of the grill of FIG. 20.
Figure 22:
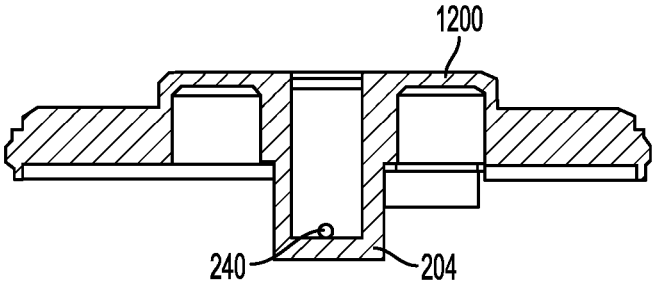
FIG. 22 is a cross-sectional view of the grill of FIG. 20 along section line A-A.
Figure 23:
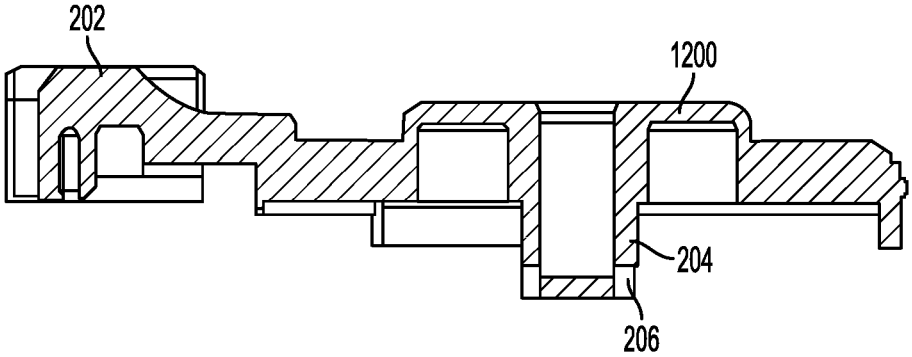
FIG. 23 is a cross-sectional view of the grill of FIG. 20 along section line B-B.
Figure 24:
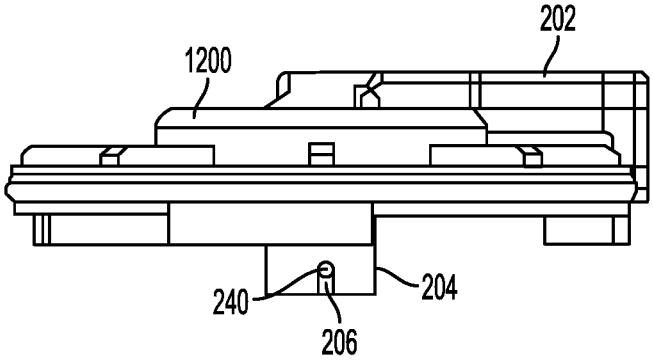
FIG. 24 is a side view of the grill of FIG. 20.

FIG. 20 provides a top view and FIG. 21 a bottom view of front grill 1200. Likewise, FIG. 22 provides a cross sectional view of front grill 1200 along section line A-A of FIG. 20, and FIG. 23 provides a cross sectional view of front grill 1200 along section line B-B of FIG. 20. Further, FIG. 24 provides a side view of front grill 1200. As shown in FIGS. 20 through 24, front grill 1200 is configured similar to front grill 120, but also includes a handle 202 affixed to outer rim 123, and a central hub 204 extending axially toward the interior of cartridge body 110. Handle 202 may be grasped by a user to rotate front grill 1200 with respect to cartridge body 110, thus controlling the axial position of outlet valve load disc 230 as described in greater detail below. Central hub 204 is sized to fit within a central receiving hub 232 on outlet valve load disc 230 (FIGS. 25-28) and roll pin 240 may be placed through an opening 206 in central hub 204 (and likewise through a guide channel in central receiving hub 232 of outlet valve load disc 230) to movably and removably attach outlet valve load disc 230 to front grill 1200.

Figure 25:
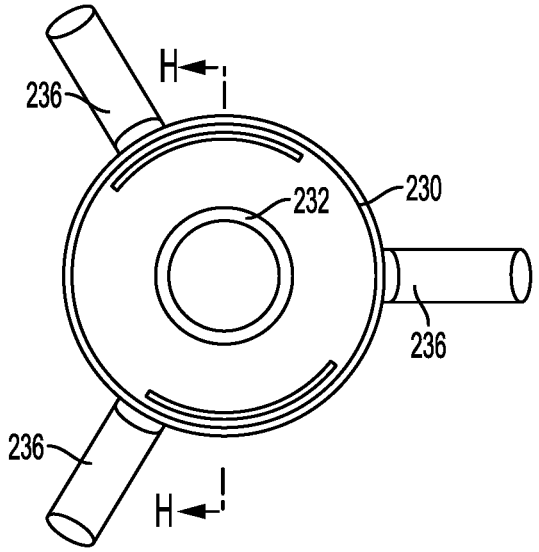
FIG. 25 is a top view of a load disc for use with the removable cartridge assembly of FIG. 14.
Figure 26:
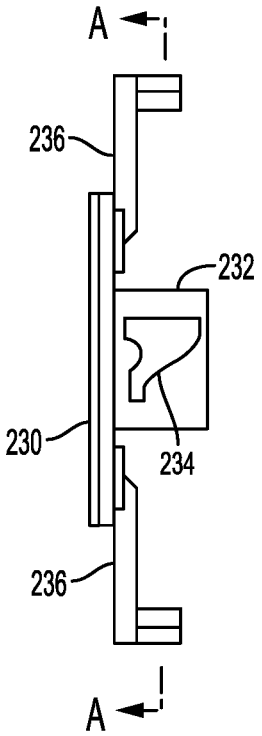
FIG. 26 is a side view of the load disc of FIG. 25.
Figure 27:
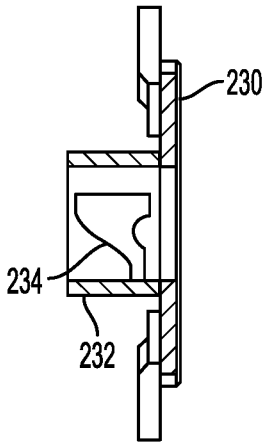
FIG. 27 is a cross-sectional view of the load disc of FIG. 25 along section line H-H.
Figure 28:
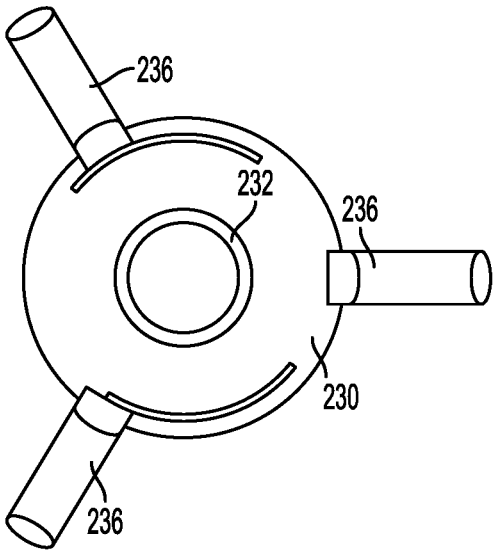
FIG. 28 is a cross-sectional view of the load disc of FIG. 25 along section line A-A of FIG. 26.

FIG. 25 is a top view (i.e., a view from the outlet side 1101 of cartridge body 110), and FIG. 26 a side view, of outlet valve load disc 230. Likewise, FIG. 27 is a cross sectional view of outlet valve load disc 230 along section line H-H of FIG. 25, and FIG. 28 is a cross sectional view of outlet valve load disc 230 along section line A-A of FIG. 26. As shown in FIGS. 25 through 28, outlet valve load disc 230 has a plurality of radially extending guide arms 236 that align with longitudinal positioning spacers 119 on the interior of cartridge body 110. Thus, when outlet valve load disc 230 is positioned within cartridge body 110, it is angularly locked in place with regard to cartridge body 110, but can move axially within cartridge body 110. However, as front grill 1200 is rotatable with respect to outlet valve load disc 230 and cartridge body 110, rotation of front grill 1200 will cause roll pin 240 (whose angular position is locked with respect to front grill 1200) to angularly move with respect to outlet valve load disc 230, riding within guide channel 234 and causing the axial position of outlet valve load disc 230 to change. Such axial movement of outlet valve load disc 230 within cartridge body 110 will likewise change its position with respect to valve 130, thus allowing outlet valve load disc 230 to exert variable amounts of force on valve 130, and enabling the change of the cartridge assembly 100 from a negative-only assembly to a positive pressure assembly.

Moreover, as front grill 1200 remains removable from cartridge body 110, each of load disc spring 220, outlet valve load disc 230, and valve 130, along with the interior of cartridge body 110, all remain easily accessible for service or replacement as may be necessary, and their assembly within cartridge body 110 is configured so that each of such elements may be separately removed or replaced through minimal modification and without requiring replacement of the other elements of the removable cartridge assembly 100.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. A serviceable cartridge assembly for a respirator exhalation unit, comprising:

a cartridge body having an air inlet side and an air outlet side;

a valve positioned on an interior of said cartridge body and configured to seal said air inlet side of said cartridge body;

a grill removably attached to said air outlet side of said cartridge body, said grill having an interior side facing said valve;

an outlet valve load disc between said grill and said valve, said outlet valve load disc having a cam surface;

a spring biasing at least a portion of said outlet valve load disc away from said grill and toward said valve; and a lifting member on said interior side of said grill and engaging said cam surface for slidable movement of said lifting member along said cam surface, wherein rotation of said grill causes said lifting member to move along said cam surface to selectively move said outlet valve load disc toward and away from said valve.

2. The serviceable cartridge assembly of claim 1, wherein said valve is reconfigurable from a negative pressure valve to a positive pressure valve.

3. The serviceable cartridge assembly of claim 2, wherein rotation of said grill with respect to said cartridge body causes said outlet valve load disc to move longitudinally within said cartridge body.

4. The serviceable cartridge assembly of claim 3, said grill further comprising a handle positioned on a downstream side of said grill and extending radially outward from said grill.

5. The serviceable cartridge assembly of claim 3, said outlet valve load disc further comprising a first cylindrical hub extending from said disc toward said grill.

6. The serviceable cartridge assembly of claim 5, said grill further comprising a second cylindrical hub extending from said grill toward said disc and sized to engage first cylindrical hub.

7. The serviceable cartridge assembly of claim 6, wherein said cam surface is positioned on said first cylindrical hub.

8. The serviceable cartridge assembly of claim 2, wherein rotation of said grill with respect to said cartridge body converts said serviceable cartridge assembly from a negative pressure valve to a positive pressure valve having a greater sealing force of said air inlet side than said negative pressure valve.

9. The serviceable cartridge assembly of claim 1, wherein said outlet valve load disc further comprises a valve engaging portion and a grill engaging portion opposite said valve engaging portion, wherein said cam surface is positioned on a cylindrical hub extending from said grill engaging portion of said outlet valve load disc.

10. A serviceable cartridge assembly for a respirator exhalation unit, comprising:

a cylindrical cartridge body having an air inlet side and an air outlet side;

a negative pressure valve positioned on an interior of said cylindrical cartridge body and configured to seal said air inlet side upon creation of a pressure below ambient pressure upstream of said air inlet side, said negative pressure valve being moveably positioned within said cartridge body;

a grill removably and rotatably attached to said air outlet side of said cartridge body, said grill having an interior side facing said valve;

an outlet valve load disc moveably mounted within said cartridge body between said grill and said valve and for longitudinal movement within said cartridge body, said outlet valve load disc having a cam surface;

a spring biasing at least a portion of said outlet valve load disc away from said grill and toward said valve; and a lifting member on said interior side of said grill and engaging said cam surface for slidable movement of said lifting member along said cam surface, wherein rotation of said grill causes said lifting member to move along said cam surface to selectively move said outlet valve load disc toward and away from said valve.

11. The serviceable cartridge assembly of claim 10, wherein said valve is reconfigurable from a negative pressure valve to a positive pressure valve.

12. The serviceable cartridge assembly of claim 11, wherein rotation of said grill with respect to said cartridge body causes said outlet valve load disc to move longitudinally within said cartridge body.

13. The serviceable cartridge assembly of claim 11, wherein rotation of said grill with respect to said cartridge body converts said serviceable cartridge assembly from a negative pressure valve to a positive pressure valve having a greater sealing force of said air inlet side than said negative pressure valve.

14. The serviceable cartridge assembly of claim 11, said grill further comprising a handle positioned on a downstream side of said grill and extending radially outward from said grill.

15. The serviceable cartridge assembly of claim 11, said spring-biased disc further comprising a first cylindrical hub extending from said disc toward said grill.

16. The serviceable cartridge assembly of claim 15, said grill further comprising a second cylindrical hub extending from said grill toward said disc and sized to engage said first cylindrical hub.

17. The serviceable cartridge assembly of claim 10, wherein said outlet valve load disc further comprises a valve engaging portion and a grill engaging portion opposite said valve engaging portion, wherein said cam surface is positioned on a cylindrical hub extending from said grill engaging portion of said outlet valve load disc.

* * * * *